US010744626B2

(12) United States Patent
Lin

(10) Patent No.: US 10,744,626 B2
(45) Date of Patent: Aug. 18, 2020

(54) SLIP TYPE TORQUE WRENCH

(71) Applicant: TORQUE-TECH PRECISION CO., LTD., Taichung (TW)

(72) Inventor: Tien-Lung Lin, Taichung (TW)

(73) Assignee: TORQUE-TECH PRECISION CO., LTD., Tiachung (TW)

( * ) Notice: Subject to any disclaimer, the term of this patent is extended or adjusted under 35 U.S.C. 154(b) by 258 days.

(21) Appl. No.: 16/051,711

(22) Filed: Aug. 1, 2018

(65) Prior Publication Data

US 2019/0039217 A1 Feb. 7, 2019

(30) Foreign Application Priority Data

Aug. 7, 2017 (TW) ..... 106126501 A

(51) Int. Cl.
*B25B 23/142* (2006.01)

(52) U.S. Cl.
CPC ..... *B25B 23/1427* (2013.01)

(58) Field of Classification Search
CPC ..... B25B 23/142; B25B 23/1427
See application file for complete search history.

(56) References Cited

U.S. PATENT DOCUMENTS 7,516,676 B2 * 4/2009 Gao ..... B25B 23/141 73/862.21
8,443,702 B2 * 5/2013 Kan ..... B25B 23/1427 81/467
9,021,921 B2 * 5/2015 Ogata ..... B25B 23/1427 81/59.1
9,089,957 B2 * 7/2015 Chen ..... B25B 23/141

* cited by examiner

*Primary Examiner* — David B. Thomas
(74) *Attorney, Agent, or Firm* — Sinorica, LLC

(57) ABSTRACT

A slip type torque wrench has a driving head. The driving head includes a fixing seat and a guiding seat therein. The fixing seat is provided with a rolling member. The guiding seat is provided with a press member. The press member is biased by an elastic unit to abut against the rolling member. A peripheral side of the guiding seat is formed with a guiding slope. The driving head has a tightening hole. A tightening member is locked to the tightening hole. One end of the tightening member abuts against the guiding slope and pushes the guiding seat for tightening the fixing seat. Thereby, the rolling member and the press member stably operate to achieve the purpose of stabilizing the output torque.

20 Claims, 9 Drawing Sheets

SLIP TYPE TORQUE WRENCH

FIELD OF THE INVENTION

The present invention relates to a torque wrench, and more particularly to a slip type torque wrench.

BACKGROUND OF THE INVENTION

A conventional slip torque wrench mainly has a tubular body. One end of the tubular body is provided with a driving head, and the other end of the tubular body is provided with a grip. Wherein, the driving head has a rotatable ratchet member. The interior of the tubular body is provided with a press member and an elastic member arranged sequentially in a direction from the driving head toward the grip. Thereby, when the user operates the slip type torque wrench to tighten a workpiece, the press member is elastically pushed by the elastic member for the press member to abut against the ratchet member, allowing the ratchet member to drive the workpiece to rotate. When the torque applied to the workpiece is greater than the elastic force of the elastic member, the ratchet member is instantaneously slipped and detached from the press member to generate an idling for outputting a constant torque.

However, since the press member of the conventional slip type torque wrench is simply placed in the tubular body, in actual operation, at the moment when the ratchet member is disengaged from the press member, the press member is likely to generate vibrations, resulting in that the output torque of the slip type torque wrench is unstable. Thus, the accuracy of the output torque is affected greatly. Moreover, the conventional slip type torque wrench doesn't have a window to display the current set torque value. Because the driving head of the conventional slip type torque wrench is coupled to the tubular body in a screwing manner, it is difficult to ensure the relative position between the driving head and the tubular body when locked. After locked, the position of the window is often not able to aim at the predetermined position. Accordingly, the inventor of the present invention has devoted himself based on his many years of practical experiences to solve these problems.

SUMMARY OF THE INVENTION

The primary object of the present invention is to provide a slip type torque wrench which can solve the disadvantage that the conventional press member is easy to generate vibrations. The slip type torque wrench of the present invention is able to stabilize the output torque.

In order to achieve the aforesaid object, the slip type torque wrench provided by the present invention comprises a tubular body. A first end of the tubular body is provided with a driving head. A second end of the tubular body is provided with a grip. The driving head has a head portion. The head portion includes an accommodating trough extending along a radial direction of the tubular body, a communication hole extending along an axial direction of the tubular body and communicating with the accommodating trough and the tubular body, and a tightening hole transversely communicating with the communication hole. A ratchet member is provided in the accommodating trough and rotatable relative to the driving head. A press unit is provided in the communication hole. The press unit has a fixing seat. The fixing seat has a slide hole therein. A rolling member is provided in the slide hole. One side of the fixing seat, facing the grip, is provided with a guiding seat. A peripheral side of the guiding seat is formed with a guiding slope corresponding to the tightened hole. The guiding slope is gradually tapered in a direction from the driving head toward the grip. The guiding seat further has a guiding hole extending along the axial direction of the tubular body. A movable press member is provided in the guiding hole. One end of the press member is pressed against the rolling member. The slip type torque wrench further comprises a tightening member. When the tightening member is locked at the tightening hole and one end of the tightening member is pressed to abut against the guiding slope, through a wedge action between the tightening member and the guiding slope, the guiding seat is moved toward the fixing seat for tightening the fixing seat and the guiding seat. The slip type torque wrench further comprises an elastic member disposed in the tubular body to elastically abut against another end of the press member, so that the press unit is elastically pushed to abut against the ratchet member.

According to the slip type torque wrench provided by the present invention, when the tightening member is locked to the tightening hole and further inserted toward the guide slope, one end of the tightening member is pressed to abut against the guiding slope. Through the wedge action between the tightening slope and the guiding slope, the guiding seat is moved toward the fixing seat to tighten the guiding seat and the fixing seat, such that the fixing seat and the guiding seat do not generate vibrations, and the rolling member can stably slide back and forth along the slide hole, and the press member can stably slide along the guiding hole back and forth to output highly stable torque.

DETAILED DESCRIPTION OF THE PREFERRED EMBODIMENTS

Embodiments of the present invention will now be described, by way of example only, with reference to the accompanying drawings.

Figure 1:
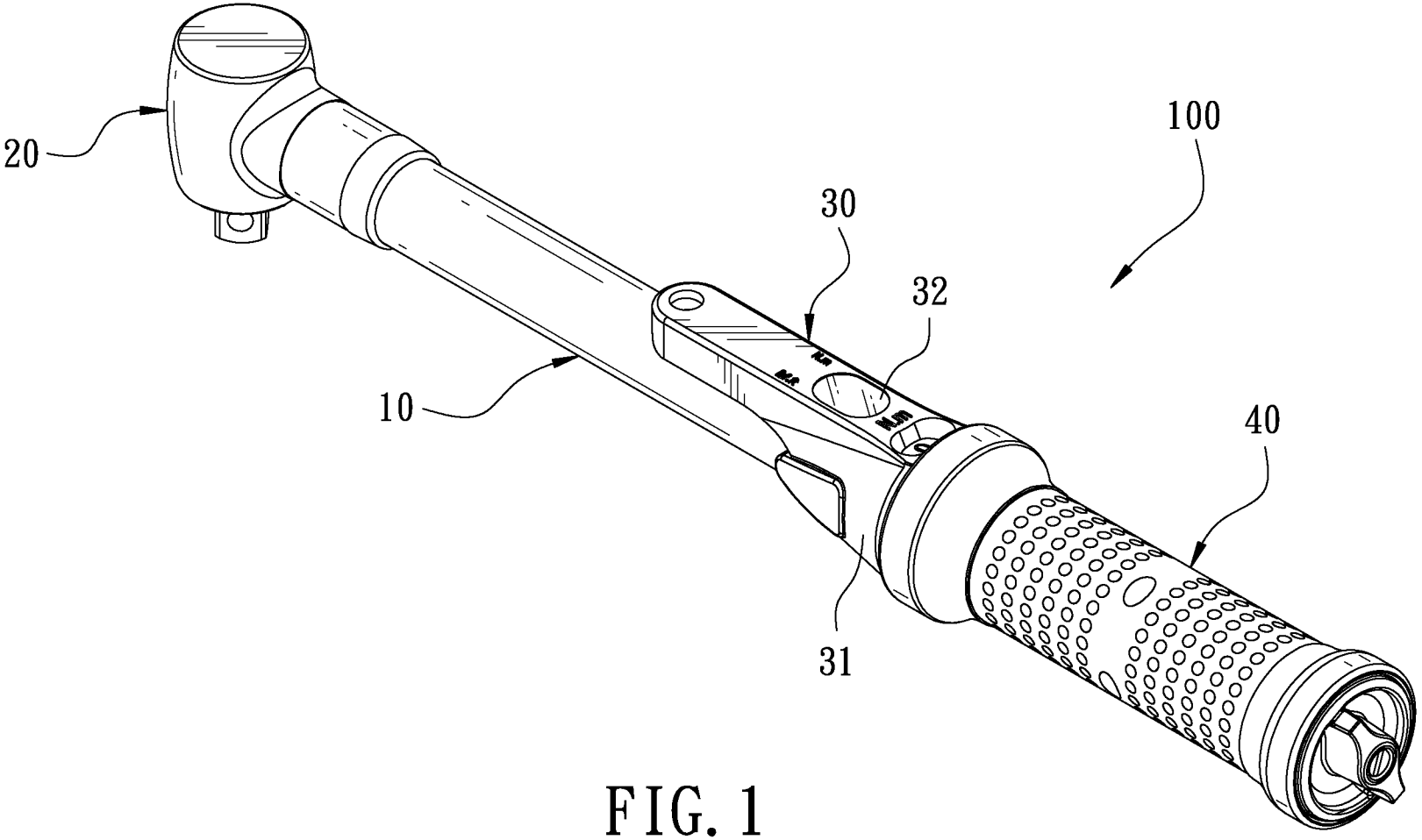
FIG. 1 is a perspective view in accordance with a first embodiment of the present invention.
Figure 2:
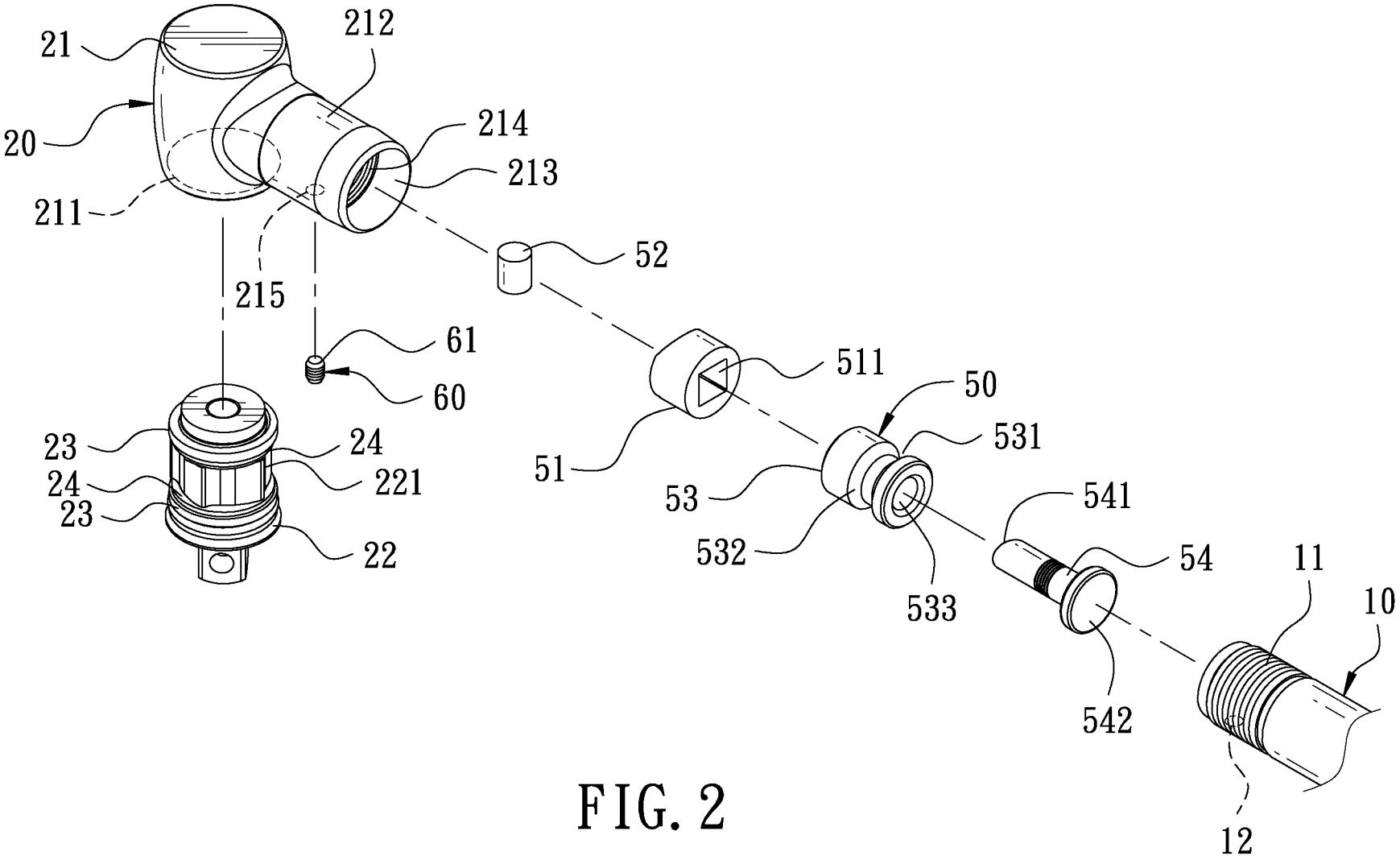
FIG. 2 is a partially exploded view in accordance with the first embodiment of the present invention.
Figure 3:
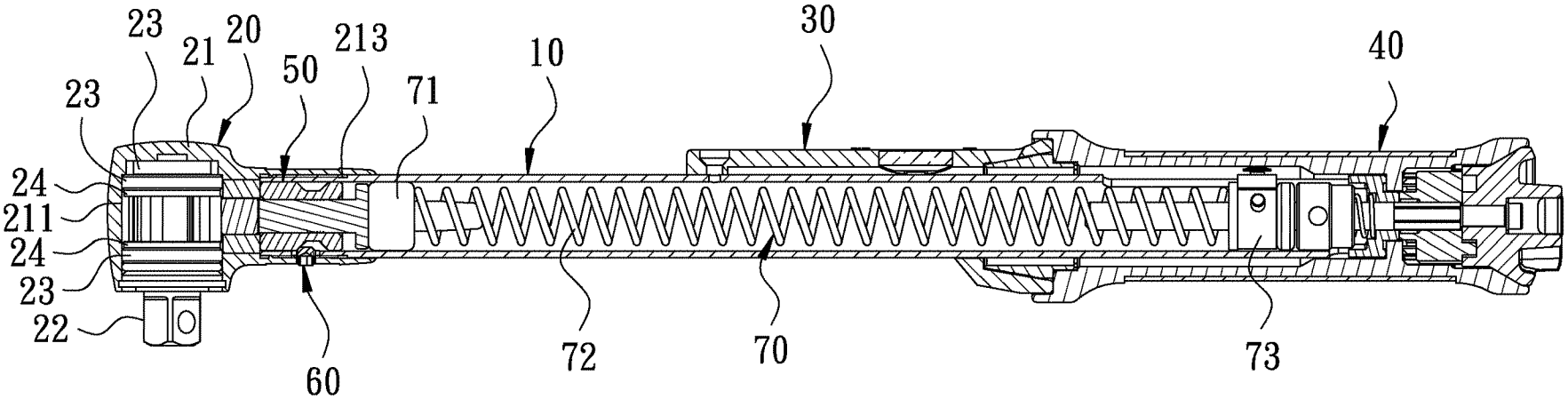
FIG. 3 is a sectional view in accordance with the first embodiment of the present invention.
Figure 4:
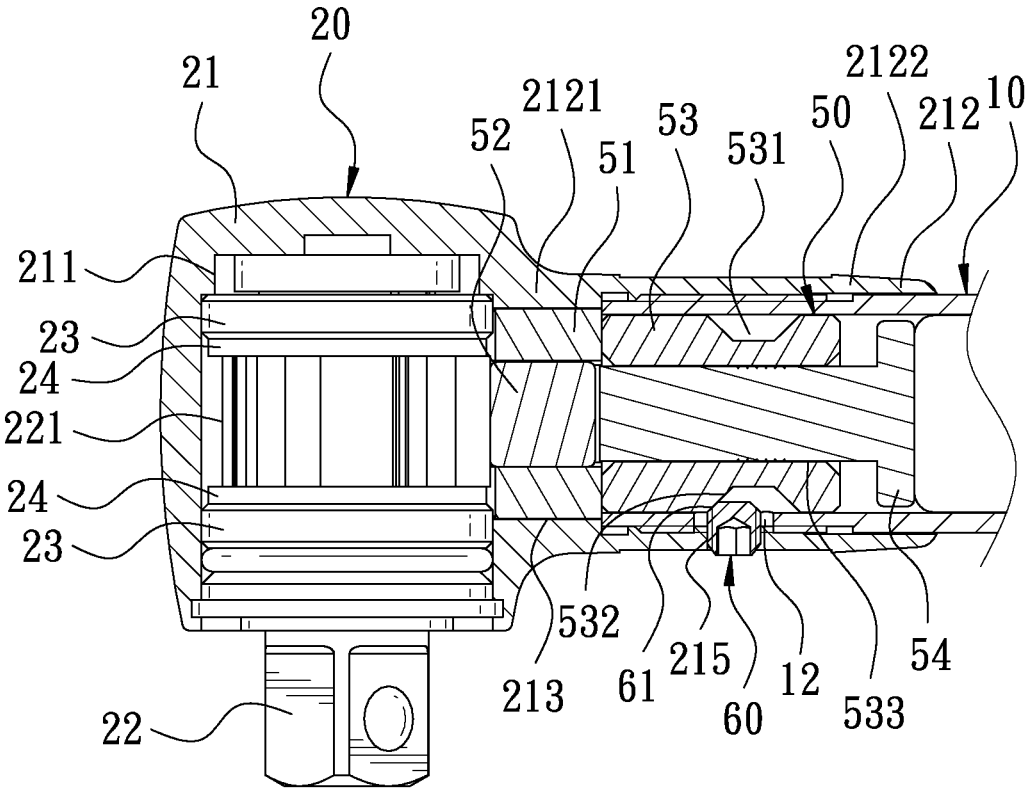
FIG. 4 is a partially enlarged sectional view in accordance with the first embodiment of the present invention.

FIG. 1 is a perspective view in accordance with a first embodiment of the present invention. FIG. 2 is a partially exploded view in accordance with the first embodiment of the present invention. FIG. 3 is a sectional view in accordance with the first embodiment of the present invention. FIG. 4 is a partially enlarged sectional view in accordance with the first embodiment of the present invention. The invention discloses a slip type torque wrench 100. The slip type torque wrench 100 includes a tubular body 10, a driving head 20, a display unit 30, a grip 40, a press unit 50, a tightening member 60, and an elastic unit 70.

The tubular body 10 has a first threaded portion 11 disposed at a first end of the tubular body 10 thereof. In this embodiment, the first threaded portion 11 is disposed on an outer wall of the tubular body 10. The tubular body 10 further has a positioning hole 12 corresponding in position to the first threaded portion 11.

The driving head 20 is disposed at the first end of the tubular body 10. Wherein, the driving head 20 has a head portion 21. The head portion 21 includes an accommodating trough 211 extending along a radial direction of the tubular body 10 and a coupling pipe 212 extending along an axial direction of the tubular body 10. The coupling pipe 212 has a first annular portion 2121 and a second annular portion 2122 connected with the first annular portion 2121. The first annular portion 2121 and the second annular portion 2122 surround a communication hole 213 in communication with the accommodating trough 211 and an interior of the tubular body 10. An inner wall surface of the communication hole 213 is provided with a second threaded portion 214 corresponding to the first threaded portion 11. The first threaded portion 11 is screwed with the second threaded portion 214 to make the driving head 20 coupled to the tubular body 10. In addition, the head portion 21 further has a tightening hole 215 corresponding in position to the positioning hole 12 and transversely communicating with the communication hole 213. The tightening hole 215 may be a screw hole. The accommodating trough 211 of the driving head 20 is provided with a ratchet member 22 rotatable relative to the driving head 20. The ratchet member 22 is provided with an annular toothed surface 221 corresponding to the communication hole 213. The driving head 20 is provided with at least one axial buffer collar 23 and at least one radial buffer collar 24 between an inner wall surface of the accommodating trough 211 and a circumferential side of the ratchet member 22. In the embodiment, an upper end and a lower end of the toothed surface 221 are sleeved with the axial buffer collar 23 and the radial buffer collar 24, respectively. The radial buffer collars 24 are located between the axial buffer collar 23 and the toothed surface 221. Two opposite sides of the radial buffer collar 24 are in contact with the axial buffer collar 23 and the toothed surface 221, respectively. The outer diameter of the radial buffer collar 24 is less than that of the axial buffer collar 23.

The display unit 30 has a positioning seat 31 fitted on the tubular body 10. The positioning seat 31 is provided with a window 32. The window 32 is configured to display the current set torque value of the slip type torque wrench 100. The window 32 is disposed at a position corresponding to the positioning hole 12. In the embodiment, the positioning hole 12 is disposed right at an underside of the tubular body 10, and the window 32 is disposed right over the tubular body 10.

The grip 40 is coupled to a second end of the tubular body 10 opposite to the first end of the tubular body 10.

The press unit 50 is disposed in the communication hole 213. Wherein, the press unit 50 has a fixing seat 51. The fixing seat 51 is disposed in the first annular portion 2121. One side of the fixing seat 51 abuts against the axial buffer collars 23. The first end of the tubular body 10 is inserted in the communication hole 213 and abuts against another side of the fixing seat 51. The fixing seat 51 has a slide hole 511 therein. A rolling member 52 is provided in the slide hole 511. The rolling member 52 may be a roller. The rolling member 52 is pressed to abut against the toothed surface 221. In addition, one side of the fixing seat 51, facing the grip 40, is provided with a guiding seat 53. The guiding seat 53 is disposed in the second annular portion 2122. The peripheral side of the guiding seat 53 is formed with an annular conical groove 531, and the annular conical groove 531 corresponding to the tightening hole 215 is formed with a guiding slope 532 which is gradually tapered inwardly in a direction from the driving head 20 toward the grip 40. Preferably, the annular conical groove 531 is recessed from the peripheral side of the guiding seat 53. In this embodiment, a groove wall of the tapered groove 531 is formed with the guiding slope 532 which is gradually tapered in the direction from the driving head 20 toward the grip 40. The guiding seat 53 further has a guiding hole 533 extending along the axial direction of the tubular body 10. The guiding hole 533 is provided with a movable press member 54. One end of the press member 54 is provided with a press slope 541. The press slope 541 is pressed to abut against the rolling member 52. Another end of the press member 54 is flared to form an enlarged portion 542.

The tightening member 60 is locked at the tightening hole 215. One end of the tightening member 60 is formed with a tightening slope 61. The tightening slope 61 is inserted through the positioning hole 12 and pressed against the guiding slope 532. The tightening member 60 may be a bolt. The tightening slope 61 abuts against the guiding slope 532 and is attached to the guiding slope 532.

The elastic unit 70 is disposed in the tubular body 10. The elastic unit 70 includes a push member 71, a spring 72 and a torsion adjustment mechanism 73 that are sequentially arranged in a direction from the driving head 20 toward the grip 40. The push member 71 is biased by the spring 72 to abut against the enlarged portion 542 of the press member 54 and further to push the press unit 50 to abut against the ratchet member 22. Wherein, the outer diameter of the push member 71 is greater than that of the spring 72.

Figure 5:
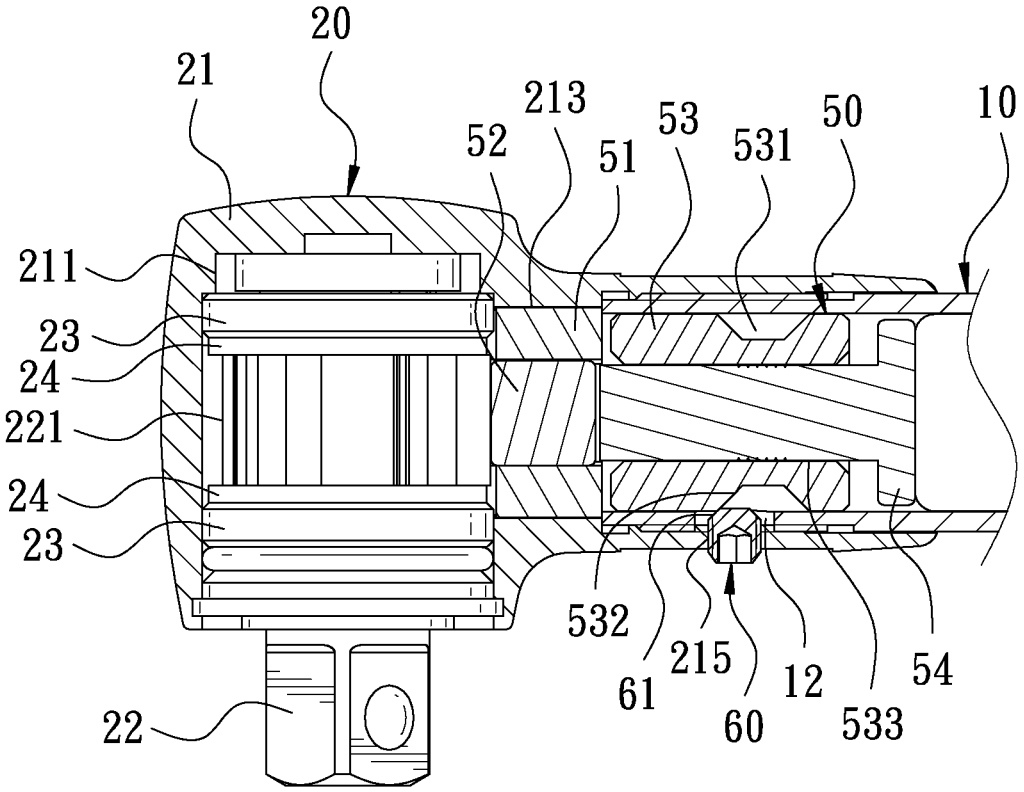
FIG. 5 is a schematic view in accordance with the first embodiment of the present invention when in use, showing that the tightening member is not pressed against the guiding slope.
Figure 6:
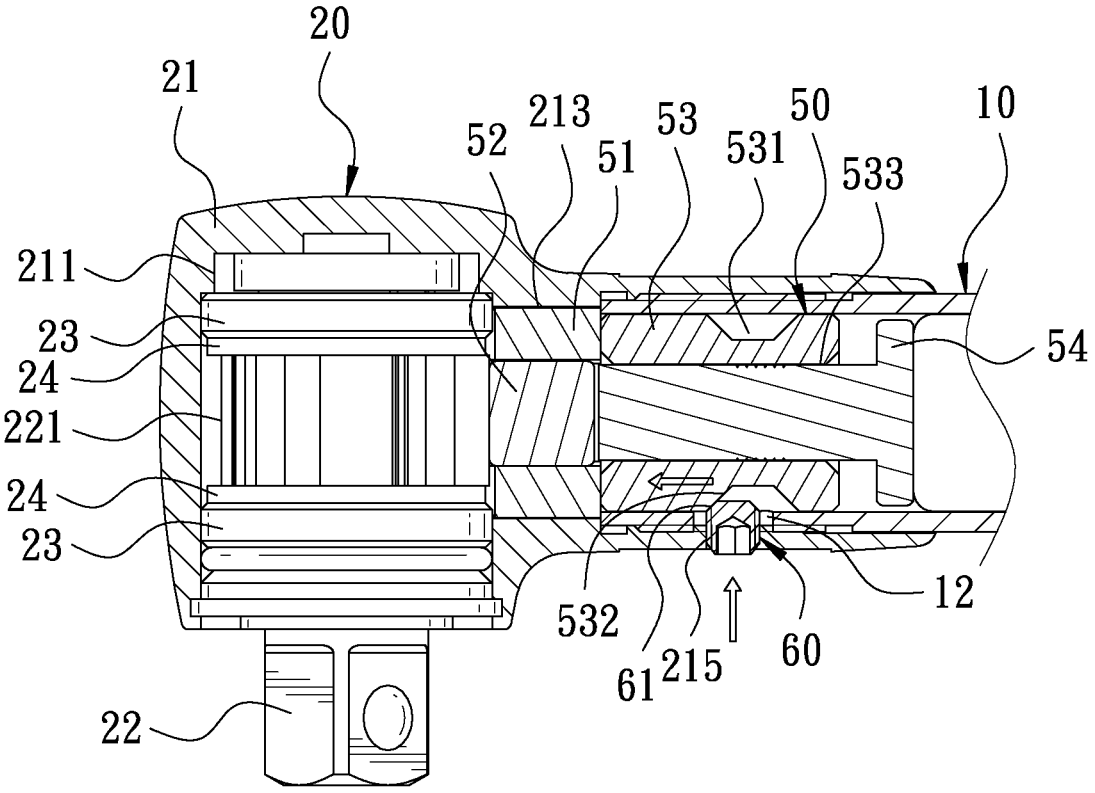
FIG. 6 is a schematic view in accordance with the first embodiment of the present invention when in use, showing that the tightening member is pressed against the guiding slope.

FIG. 5 is a schematic view in accordance with the first embodiment of the present invention when in use, showing that the tightening member is not pressed against the guiding slope yet. FIG. 6 is a schematic view in accordance with the first embodiment of the present invention when in use, showing that the tightening member is pressed against the guiding slope. When the tightening member 60 is locked at the tightening hole 215 and further inserted toward the guiding slope 532, the tightening slope 61 of the tightening member 60 is attached to and abuts against the guiding slope 532 of the guiding seat 53. By means of wedge action between the tightening slope 61 and the guiding slope 532, the guiding seat 53 is moved toward the fixing seat 51. The fixing seat 51 and the guiding seat 53 are tightened between the axial buffer collars 23 and the tightening member 60, so that the fixing seat 51 and the guiding seat 53 don't possess the degree of freedom for axial movement. Thus, when the slip type torque wrench 100 is in operation and the ratchet member 22 is momentarily slipped and detached from the rolling member 52, the fixing seat 51 and the guiding seat 53 do not generate vibrations, and the rolling member 52 stably slides back and forth along the slide hole 511, and the press member 54 stably slides along the guiding hole 533 back and forth to output highly stable torque.

It is worth mentioning that in this embodiment the tightening member 60 is locked at the tightening hole 215 in a screwing manner, so that the principle of the screw-like one-way transmission can be utilized to make the tightening member 60 push the guiding seat 53 to move only in one direction, and the guiding seat 53 cannot push the tightening member 60 in the reverse direction, thereby preventing the tightening member 60 from being loosened by the reverse force.

It is worth mentioning that when the tightening member 60 is locked in the tightening hole 215 and the guiding seat 53 is pushed to move the fixing seat 51 toward the ratchet member 22, because the outer diameter of the radial buffer collar 24 is less than that of the axial buffer collar 23, thus the fixing seat 51 is pressed to abut against the axial buffer collars 23, and a gap is defined between the radial buffer collars 24 and the fixing seat 51, that is, the radial buffer collars 24 do not get in contact with the fixing seat 51. Thus, when the torque wrench 100 is impacted by an external force, for example, falling down to the ground inadvertently, the axial external force of the torque wrench 100 can be absorbed through the axial buffer collars 23, and the radial external force of the torque wrench 100 can be absorbed through the radial buffer collars 24 to prevent the accuracy of output torque from being affected.

Figure 7:
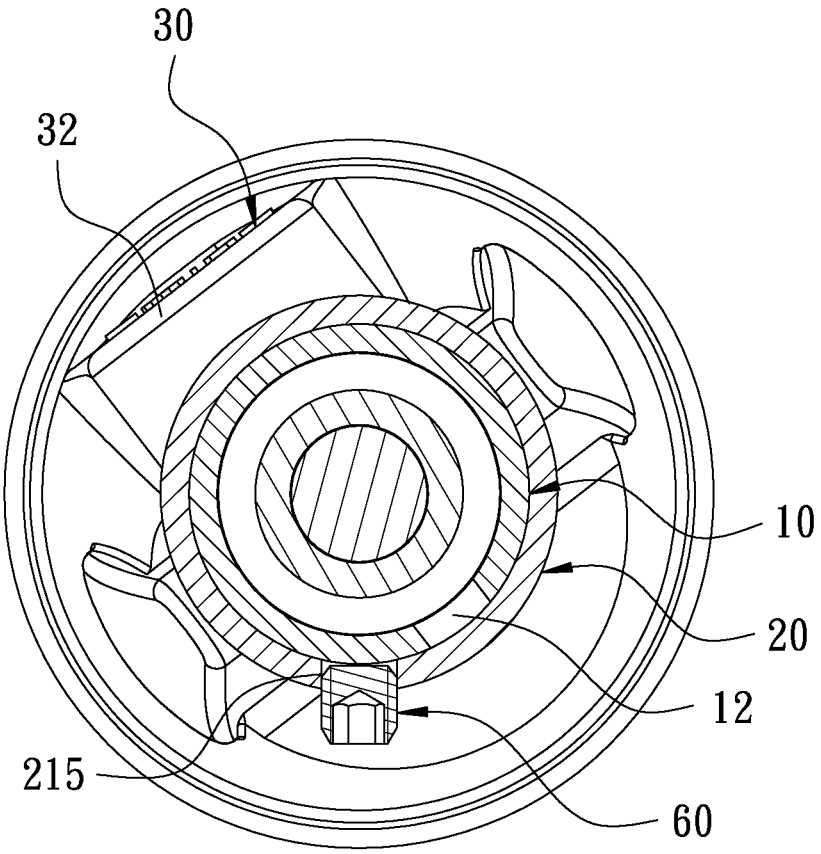
FIG. 7 is a schematic view in accordance with the first embodiment of the present invention when in use, showing that the window is not positioned.
Figure 8:
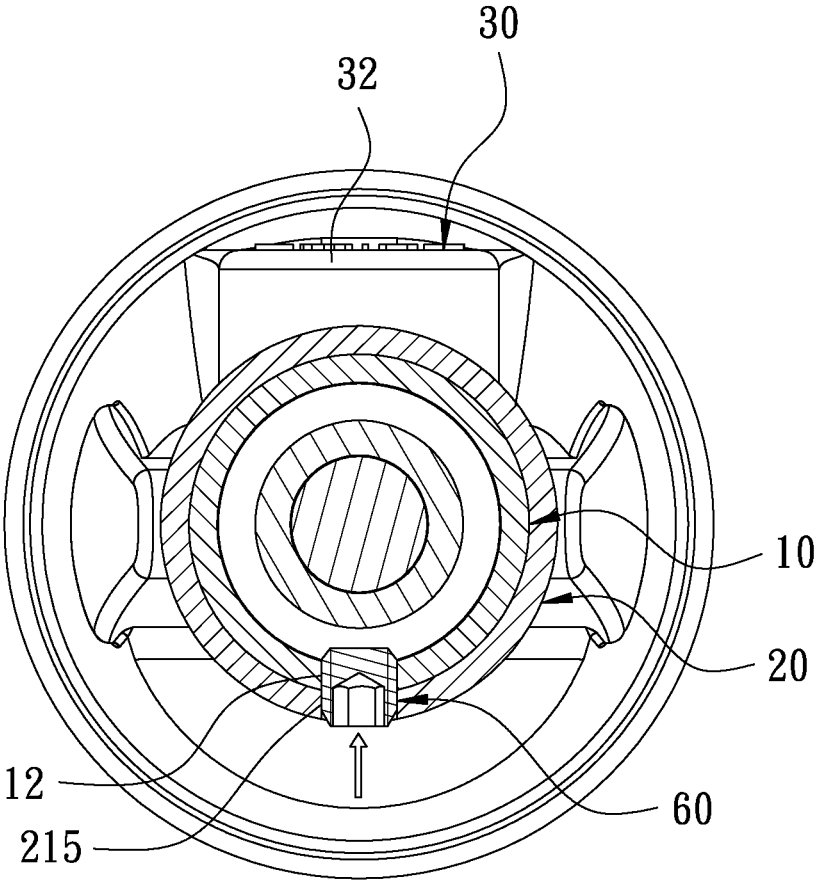
FIG. 8 is a schematic view in accordance with the first embodiment of the present invention when in use, showing that the window is positioned.

FIG. 7 is a schematic view in accordance with the first embodiment of the present invention when in use, showing that the window is not positioned yet. FIG. 8 is a schematic view in accordance with the first embodiment of the present invention when in use, showing that the window is well positioned. Since the driving head 20 is coupled to the tubular body 10 through the first threaded portion 11 and the second threaded portion 214, when the user tightens the driving head 20 and the tubular body 10 and finds out that the window 32 does not face upwardly, the driving head 20 and the tubular body 10 can be appropriately loosened at this time, and the positioning hole 12 is adjusted to be aligned with the tightening hole 215, and then the tightening member 60 is screwed into the tightening hole 215, and one end of the tightening member 60 is inserted through the positioning hole 12 to abut against the guiding slope 532. Thereby, through the screwing of the first threaded portion 11 and the second threaded portion 214, there is no degree of freedom for axial movement between the driving head 20 and the tubular body 10. By the tightening member 60 passing through the positioning hole 12, there is no degree of freedom for rotation between the driving head 20 and the tubular body 10. Accordingly, the driving head 20 is effectively coupled to the tubular body 10, and the relative position of the driving head 20 and the tubular body 10 can be well positioned, so that the window 32 can be accurately located at a predetermined position by the user. For example, in this embodiment, the window 32 is oriented directly upward, thereby overcoming the disadvantage that the conventional slip type torque wrench cannot be provided with a window owing to positioning issue.

It is worth mentioning that the elastic unit 70 is elastically abutted against the enlarged portion 542 of the press member 54 through the push member 71, and the outer diameter of the push member 71 is greater than that of the spring 72, so that during the operation of the slip type torque wrench 100, the spring 72 does not get in contact with the inner wall of the tubular body 10 to prevent the inner wall of the tubular body 10 from being scratched by the spring 72, thereby preventing the output torque from being affected.

Figure 9:
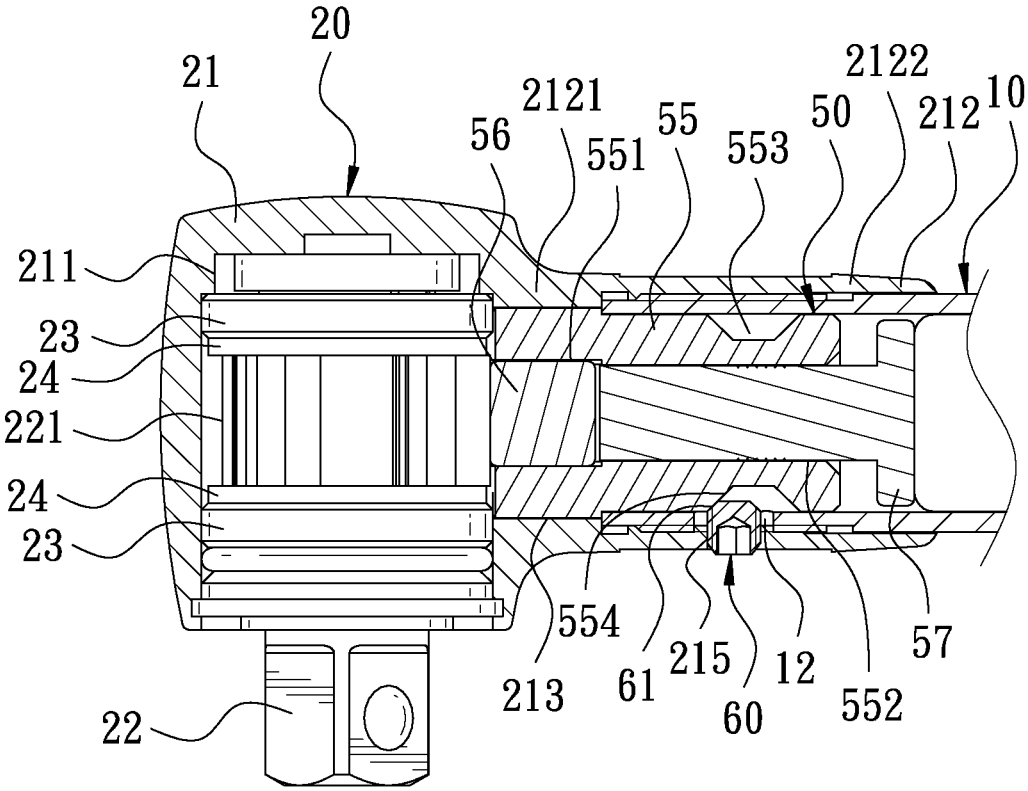
FIG. 9 is a partially enlarged sectional view in accordance with a second embodiment of the present invention.

FIG. 9 is a partially enlarged sectional view in accordance with a second embodiment of the present invention. The second embodiment is substantially similar to the first embodiment with the exceptions described hereinafter. The press unit 50 has a guiding seat 55. One side of the guiding seat 55, facing the ratchet member 22, is provided with a slide hole 551. A rolling member 56 is provided in the slide hole 551. Another side of the guiding seat 55, facing the grip 40, is provided with a guiding hole 552 extending along the axial direction of the tubular body 10 and communicating with the slide hole 551. A movable press member 57 is provided in the guiding hole 552. Wherein, one end of the press member 57 is pressed to abut against the rolling member 56, and another end of the press member 57 is pushed by the elastic unit 70. The peripheral side of the guiding seat 55 is formed with an annular conical groove 553, and the annular conical groove 553 corresponding to the tightening hole 215 is formed with a guiding slope 554 which is gradually tapered inwardly in the direction from the driving head 20 toward the grip. Preferably, the annular conical groove 553 is recessed from the peripheral side of the guiding seat 55. In this embodiment, a groove wall of the annular conical groove 553 is formed with the guiding slope 554 which is gradually tapered in the direction from the driving head 20 toward the grip. When the tightening member 60 is locked at the tightening hole 215 and one end of the tightening member 60 is pressed to abut against the guiding slope 554, the guiding seat 55 is moved toward the ratchet member 22 by means of wedge action between a tightening slope 61 of the tightening member 60 and the guiding slope 554 for making the guiding seat 55 tightened between the axial buffer collar 23 and the tightening member 60, so that the second embodiment can achieve the same effect as the first embodiment.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A slip type torque wrench including a tubular body, a first end of the tubular body being provided with a driving head, a second end of the tubular body being provided with a grip, the driving head having a head portion, the head portion including an accommodating trough extending along a radial direction of the tubular body and a communication hole extending along an axial direction of the tubular body and communicating with the accommodating trough and an interior of the tubular body, a ratchet member being provided in the accommodating trough and rotatable relative to the driving head, the ratchet member being provided with an annular toothed surface corresponding to the communication hole, a press unit being provided in the communication hole, the press unit being connected with an elastic member disposed in the tubular body so that the press unit is elastically pushed to abut against the ratchet member; characterized by:

the head portion of the driving head further having a tightening hole transversely communicating with the communication hole;

the press unit having a fixing seat, the fixing seat having a slide hole therein, a rolling member being provided in the slide hole, the rolling member being pressed to abut against the toothed surface, one side of the fixing seat facing the grip and being provided with a guiding seat, a peripheral side of the guiding seat being formed with a guiding slope which is gradually tapered in a direction from the driving head toward the grip, the guiding seat further having a guiding hole extending along the axial direction of the tubular body, the guiding hole being provided with a movable press member, one end of the press member being pressed against the rolling member, another end of the press member being pushed by the elastic unit;

a tightening member, wherein when the tightening member is locked at the tightening hole and one end of the tightening member is pressed to abut against the guiding slope, by means of wedge action between the tightening member and the guiding slope, the guiding seat is moved toward the fixing seat for tightening the fixing seat and the guiding seat.

2. The slip type torque wrench as claimed in claim 1, wherein an annular conical groove is recessed from the peripheral side of the guiding seat, a groove wall of the annular conical groove is gradually tapered in the direction from the driving head toward the grip, and the groove wall of the tapered groove is formed with the guiding slope.

3. The slip type torque wrench as claimed in claim 1, wherein the end of the tightening member is formed with a tightening slope, and the tightening slope is pressed to abut against the guiding slope.

4. The slip type torque wrench as claimed in claim 1, wherein the tightening hole is a screw hole, and the tightening member is a bolt.

5. The slip type torque wrench as claimed in claim 1, wherein the driving head is provided with at least one axial buffer collar between an inner wall surface of the accommodating trough and a circumferential side of the ratchet member, when the tightening member is locked at the tightening hole and the end of the tightening member is pressed to abut against the guiding slope, and the guiding seat is pushed so that one side of the fixing seat is pressed to abut against the axial buffer collar.

6. The slip type torque wrench as claimed in claim 5, wherein the driving head is provided with at least one radial buffer collar between the inner wall surface of the accommodating trough and the circumferential side of the ratchet member, the radial buffer collar has an outer diameter less than that of the axial buffer collar, when one side of the fixing seat is pressed to abut against the axial buffer collar, a gap is defined between the radial buffer collar and the fixing seat so that the radial buffer collar is not in contact with the fixing seat.

7. The slip type torque wrench as claimed in claim 6, wherein the radial buffer collar is located between the axial buffer collar and the toothed surface, and two opposite sides of the radial buffer collar are in contact with the axial buffer collar and the toothed surface, respectively.

8. The slip type torque wrench as claimed in claim 1, wherein the head portion of the driving head includes a coupling pipe extending along the axial direction of the tubular body, the coupling pipe has a first annular portion and a second annular portion connected with the first annular portion, the first annular portion is located close to the ratchet member, the second annular portion is located close to the grip, the first annular portion and the second annular portion surround the communication hole, the fixing seat is disposed in the first annular portion, the first end of the tubular body, the guiding seat and the press member are disposed in the second annular portion, and the first end of the tubular body is inserted in the communication hole.

9. The slip type torque wrench as claimed in claim 1, wherein the first end of the tubular body is provided with a first threaded portion, the head portion of the driving head is provided with a second threaded portion, and the first threaded portion is screwed with the second threaded portion so that the driving head is coupled to the tubular body.

10. The slip type torque wrench as claimed in claim 1, wherein the tubular body has a positioning hole, the tightening hole of the head portion is approximately aligned with the positioning hole, and the tightening member is inserted into the tightening hole and the positioning hole.

11. The slip type torque wrench as claimed in claim 1, further comprising a display unit, the display unit having a positioning seat fitted on the tubular body, the positioning seat being provided with a window, the window being configured to display a current set torque value of the slip type torque wrench.

12. A slip type torque wrench including a tubular body, a first end of the tubular body being provided with a driving head, a second end of the tubular body being provided with a grip, the driving head having a head portion, the head portion including an accommodating trough extending along a radial direction of the tubular body and a communication hole extending along an axial direction of the tubular body and communicating with the accommodating trough and the tubular body, a ratchet member being provided in the accommodating trough and rotatable relative to the driving head, the ratchet member being provided with an annular toothed surface corresponding to the communication hole, at least one axial buffer collar being provided between an inner wall surface of the accommodating trough and a circumferential side of the ratchet member, a press unit being provided in the communication hole, the press unit being connected with an elastic member disposed in the tubular body so that the press unit is elastically pushed to abut against the ratchet member; characterized by:

the head portion of the driving head further having a tightening hole transversely communicating with the communication hole;

the press unit having a guiding seat, one side of the guiding seat facing the ratchet member and being provided with a slide hole, a rolling member being provided in the slide hole, the rolling member abutting against the toothed surface, another side of the guiding seat facing the grip and being provided with a guiding hole extending along the axial direction of the tubular body and communicating with the slide hole, a movable press member being provided in the guiding hole, one end of the press member being pressed to abut against the rolling member, another end of the press member being pushed by the elastic unit, a peripheral side of the guiding seat being formed with a guiding slope corresponding to the tightening hole, the guiding slope being gradually tapered in a direction from the driving head toward the grip;

a tightening member, wherein when the tightening member is locked at the tightening hole and one end of the tightening member is pressed to abut against the guiding slope, by means of wedge action between the tightening member and the guiding slope, the guiding seat is moved toward the ratchet member to tighten the guiding seat between the axial buffer collar and the tightening member.

13. The slip type torque wrench as claimed in claim 12, wherein the driving head is provided with at least one radial buffer collar between the inner wall surface of the accommodating trough and the circumferential side of the ratchet member, the radial buffer collar has an outer diameter less than that of the axial buffer collar, when one side of the guiding seat is pressed to abut against the axial buffer collar, a gap is defined between the radial buffer collar and the guiding seat so that the radial buffer collar is not in contact with the guiding seat.

14. The slip type torque wrench as claimed in claim 13, wherein the radial buffer collar is located between the axial buffer collar and the toothed surface, and two opposite sides of the radial buffer collar are in contact with the axial buffer collar and the toothed surface, respectively.

15. The slip type torque wrench as claimed in claim 12, wherein an annular conical groove is recessed from the peripheral side of the guiding seat, a groove wall of the annular conical groove is gradually tapered in the direction from the driving head toward the grip, and the groove wall of the tapered groove is formed with the guiding slope.

16. The slip type torque wrench as claimed in claim 12, wherein the end of the tightening member is formed with a tightening slope, and the tightening slope is pressed to abut against the guiding slope.

17. The slip type torque wrench as claimed in claim 12, wherein the first end of the tubular body is inserted in the communication hole of the driving head.

18. The slip type torque wrench as claimed in claim 12, wherein the first end of the tubular body is provided with a first threaded portion, the head portion of the driving head is provided with a second threaded portion, and the first threaded portion is screwed with the second threaded portion so that the driving head is coupled to the tubular body.

19. The slip type torque wrench as claimed in claim 12, wherein the tubular body has a positioning hole, the tightening hole of the head portion is approximately aligned with the positioning hole, and the tightening member is inserted in the tightening hole and the positioning hole.

20. The slip type torque wrench as claimed in claim 12, further comprising a display unit, the display unit having a positioning seat fitted on the tubular body, the positioning seat being provided with a window, the window being configured to display a current set torque value of the slip type torque wrench.

* * * * *